US007850169B2

(12) United States Patent
Minami

(10) Patent No.: US 7,850,169 B2
(45) Date of Patent: Dec. 14, 2010

(54) AUTOMATIC ORIGINAL FEEDER

(75) Inventor: Kazumasa Minami, Nagoya (JP)

(73) Assignee: Ricoh Company, Ltd., Tokyo (JP)

( * ) Notice: Subject to any disclaimer, the term of this patent is extended or adjusted under 35 U.S.C. 154(b) by 262 days.

(21) Appl. No.: 11/498,822

(22) Filed: Aug. 4, 2006

(65) Prior Publication Data

US 2007/0029720 A1 Feb. 8, 2007

(30) Foreign Application Priority Data

Aug. 4, 2005 (JP) ..... 2005-226117
Jul. 25, 2006 (JP) ..... 2006-201468

(51) Int. Cl.
*B65H 5/02* (2006.01)

(52) U.S. Cl. ..... 271/273; 271/124; 271/125; 271/274

(58) Field of Classification Search ..... 271/121, 271/122, 124, 125, 265.01, 265.04, 272, 271/273, 188, 274; 226/154, 155, 140, 142, 226/35, 176, 177
See application file for complete search history.

(56) References Cited

U.S. PATENT DOCUMENTS 4,104,963 A * 8/1978 Fortmann ..... 100/176
4,294,414 A * 10/1981 Gerstenberg ..... 241/222
5,470,052 A * 11/1995 Asakawa et al. ..... 271/118
5,954,329 A * 9/1999 Kobayashi et al. ..... 271/122
5,959,383 A * 9/1999 Winzen et al. ..... 310/90.5
5,967,512 A * 10/1999 Irsik ..... 271/273
6,508,465 B1 * 1/2003 Endo ..... 271/265.01
6,619,649 B2 * 9/2003 Takamatsu ..... 271/3.14

FOREIGN PATENT DOCUMENTS

JP 11-322105 11/1999

* cited by examiner

*Primary Examiner*—Patrick Mackey
*Assistant Examiner*—Ernesto Suarez
(74) *Attorney, Agent, or Firm*—Harness, Dickey & Pierce, P.L.C.

(57) ABSTRACT

A feed roller and a separation roller each having convex portions are arranged so that the convex portions engage with each other. A lever is provided such that one end of the lever is fixed to a rotatable shaft and other end slides on a shaft around which the separation roller rotates. The other end has at least two portions with different radii of curvature. A knob is integrally connected to the lever. When a user operates the knob, the lever rotates and the shaft around which the separation roller rotates is pushed away depending on the radii of curvature of the portion of the lever so that amount of engagement between the feed roller and the separation roller changes.

13 Claims, 8 Drawing Sheets

AUTOMATIC ORIGINAL FEEDER

CROSS-REFERENCE TO RELATED APPLICATIONS

The present document incorporates by reference the entire contents of Japanese priority documents, 2005-226117 filed in Japan on Aug. 4, 2005 and 2006-201468 filed in Japan on Jul. 25, 2006.

BACKGROUND OF THE INVENTION

1. Field of the Invention

The present invention relates to an automatic original feeder for use in an image scanner or an image forming device.

2. Description of the Related Art

Some automatic original feeders include a separating and feeding unit that includes a comb tooth-like feed roller and a comb tooth-like separation roller. A plurality of convex portions that protrude in a diameter direction of the roller shaft of the feed roller are formed on the surface of the feed roller at predetermined intervals. The feed roller rotates in a direction of feeding of an original. A plurality of convex portions that protrudes in a diameter direction of the roller shaft of the separation roller are formed on the surface of the separation roller at predetermined intervals. The separation roller rotates in an opposite direction to the direction of feeding of the original. The feed roller and the separation roller are positioned such that their convex portions get engaged with each other. The amount for which the feed roller and the separation roller engage with each other is called the engagement amount. As the feed roller and the separation roller rotate, they pickup an original from a stack of originals. A conventional technique has been disclosed in, for example, Japanese Patent Application Laid-Open No. 11-322105.

It is common to make the roller shaft of the separation roller from resin instead of iron or stainless steel, because resin has higher elasticity than iron or stainless steel.

However, in the conventional automatic original feeders, the engagement amount is fixed, so that originals with thickness or quality in a certain range can only go well with them. In other words, there is a restriction on the original that can be used.

SUMMARY OF THE INVENTION

It is an object of the present invention to at least partially solve the problems in the conventional technology.

According to an aspect of the present invention, an automatic original feeder includes a rotatable feed roller having a plurality of feed convex portions that protrude away from an axis of rotation of the feed roller; a rotatable separation roller that rotates in an opposite direction to a direction of rotation of the feed roller, the separation roller having a plurality of separation convex portions that protrude away from an axis of rotation of the separation roller, the feed roller and the separation roller are arranged so that the feed convex portions and the separation convex portions engage with each other and feed an original from the engaged portion to a unit on downstream side in a direction of feeding of the original; and a changing member that changes an amount of engagement between the feed roller and the separation roller.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention will be explained with reference to the accompanying drawings. The invention is not limited to the following embodiments.

Figure 1:
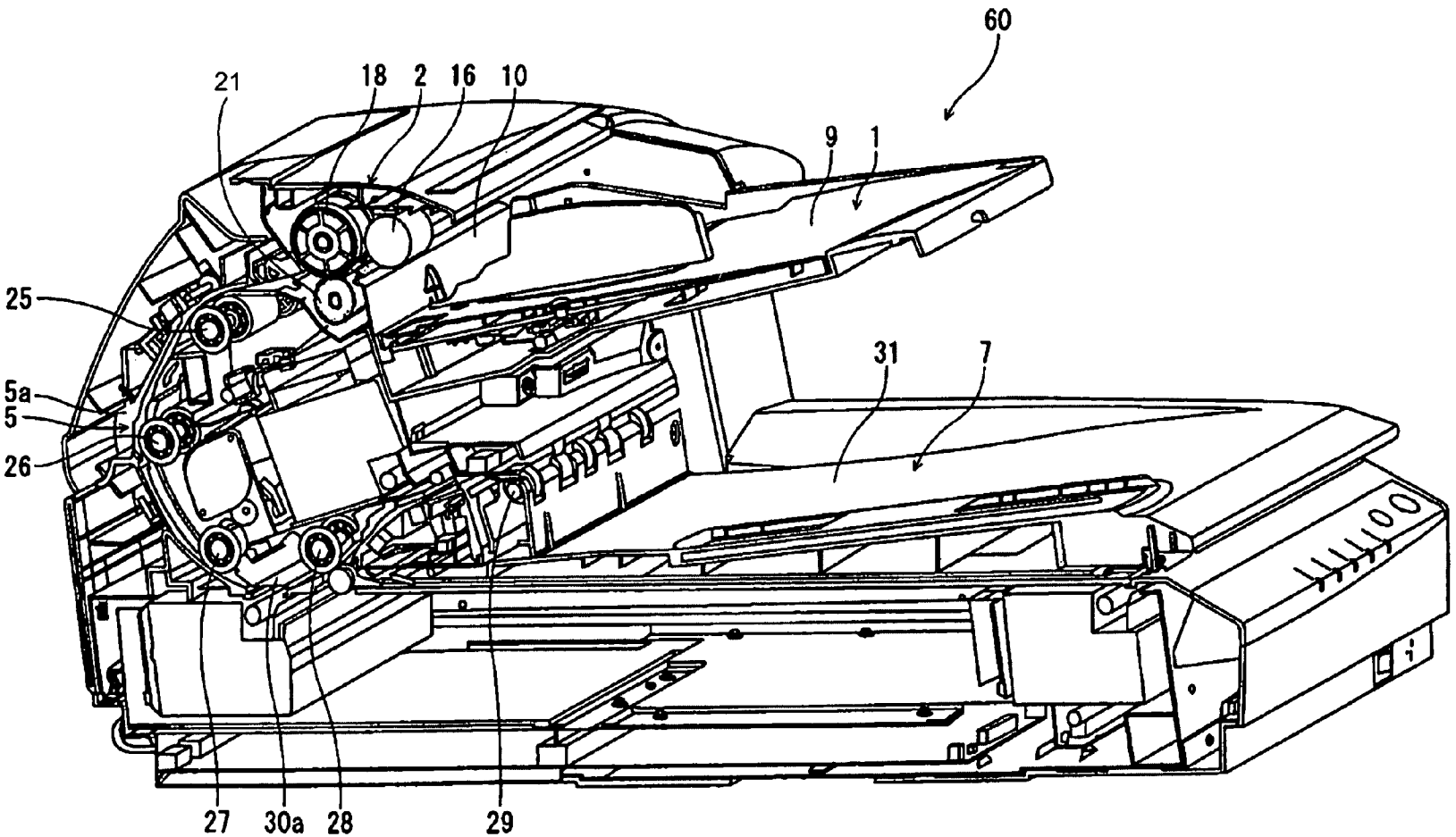
FIG. 1 is a perspective of an automatic original feeder according to a first embodiment of the present invention.

FIG. 1 is a perspective of an automatic original feeder 60 according to a first embodiment of the present invention. The automatic original feeder 60 is mounted on an image scanner. Such an image scanner is generally provided in an image forming apparatus such as a copier, a multi-function product or a facsimile machine. The automatic original feeder 60 feeds an original, generally from a stack of originals, to the image scanner.

The automatic original feeder 60 includes an original setting unit 1, a separating and feeding unit 2, a transporting unit 5, and a discharging unit 7. An original, or a stack of originals, is placed on the original setting unit 1. The separating and feeding unit 2 feeds the originals set on the original setting unit 1 one by one to the transporting unit 5. The transporting unit 5 transports the original to the discharging unit 7 via a charge coupled device (CCD) module provided at a read position 30*a* in the image scanner. The CCD module reads an image of the surface of the original. The discharging unit 7 discharges the original to the outside of the image scanner.

The original setting unit 1 includes a base plate 9 on which an original or a stack of originals are actually placed. When picking up an original from the original setting unit 1, an image forming apparatus (not shown) on which the image scanner and the automatic original feeder 60 are mounted sends a signal to the automatic original feeder 60. When the automatic original feeder 60 receives such a signal, it raises a far side of the base plate 9. The base plate 9 is raised until an original feed-position sensor (not shown) provided in the original setting unit 1 detects that the original placed on the base plate 9 has reached to a position at which the original can be fed (hereinafter, "original feed position"). At the original feed position, the original abuts an abutment guide 10 of the original setting unit 1, thereby positioning the original, and is pressurized and held firmly by a pickup roller 16 of the separating and feeding unit 2. If a stack of originals is placed in the original setting unit 1, the stack of the originals is pressurized and held firmly by the pickup roller 16. The separating and feeding unit 2 includes a feed roller 18 and a separation roller 21. The feed roller 18 and the separation roller 21 separate, or pick-up, only one original from among the stack of originals pressurized by the pickup roller 16.

The raised base plate 9 is monitored by the original feed-position sensor and controlled to be always located at the original feed position. Furthermore, the base plate 9 is lowered if an original-set detection sensor (not shown) provided in the original setting unit 1 detects that there is no original on the base plate 9.

The original picked-up by the feed roller 18 and the separation roller 21 is fed toward a first transport roller 25, a second transport roller 26, and a third transport roller 27 of the transporting unit 5. When an original detection sensor (not shown) provided right after the feed roller 18 detects trailing edge of the original, i.e., when the leading edge of the original has reached the first transport roller 25, driving of the pickup roller 16 is stopped. The original is then transported by the first transport roller 25, the second transport roller 26, and the third transport roller 27. When a registration sensor (not shown) provided right after the third transport roller 27 detects the trailing edge of the original, timing of causing the trailing edge of the original to pass through the read position 30*a* of the image scanner is matched to timing of starting reading an image from the original.

The image forming apparatus can operate in one-sided reading mode in which an image on one of the two surfaces of an original is scanned in one operation, and a double-sided reading mode in which an image on each of the two surfaces of an original are read in one operation. A user can set any one of the one-sided reading mode and the double-sided reading mode as desired. The discharging unit 7 includes a fourth transport roller 28, a discharge roller 29, and a discharge stacker 31. If the user sets the one-sided reading mode, then an image on one surface of the original is read at the read position 30*a*, and finally the fourth transport roller 28 and the discharge roller 29 transport the original to the discharge stacker 31. If the user sets the double-sided reading mode, then an image on one surface of the original is read at the read position 30*a*, the original is flipped, an image on the other surface of the original is read at the read position 30*a*, and finally the fourth transport roller 28 and the discharge roller 29 transport the original to the discharge stacker 31.

The separating and feeding unit 2 will be explained below in more detail while referring to FIGS. 2 to 7. The separating and feeding unit 2 includes the pickup roller 16, the feed roller 18, the separation roller 21, a changing member 44, an extending unit 53, and a dip switch 55. The changing member 44 has a configuration that makes it possible to change an engagement amount X by which the feed roller 18 and the separation roller 21 engage with each other (see FIG. 3). The extending unit 53 sets time of driving the pickup roller 16 to time that exceeds reference time. The dip switch 55 actuates the extending unit 53.

Figure 2:
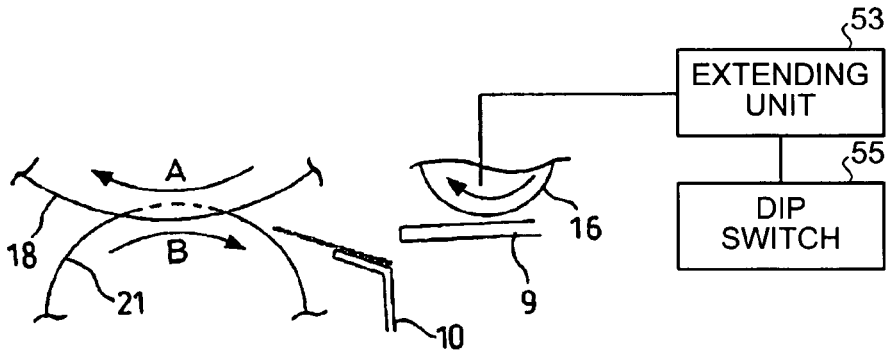
FIG. 2 is a schematic of a separating and feeding unit of the automatic original feeder according to the first embodiment.

The feed roller 18 is rotatable around a feed roller shaft 40 (see FIG. 4) in a feed direction indicated by an arrow A in FIG. 2. The feed roller shaft 40 is pivotally supported by a structure provided in the automatic original feeder 60 through a bearing (not shown). The separation roller 21 is rotatable around a separation roller shaft 42 (see FIG. 7) in a direction indicated by an arrow B, which is opposite to the direction indicated by the arrow A, in FIG. 2. The separation roller shaft 42 is pivotally supported by a holding member 19 provided in the automatic original feeder 60 through bearings 22*a* and 22*b*. Each of the bearings 22*a* and 22*b* is a sintered bearing with a polygonal cross section. The holding member 19 includes springs 19*a* and 19*b* that hold the separation roller 21 so that the separation roller 21 can be freely engaged with or separated from the feed roller 18.

In the first embodiment, an engagement amount X, which corresponds to an ordinary-thickness original, is secured between the separation roller 21 and the feed roller 18. If a thicker original or a firm original is to be used, the engagement amount is changed according to the thickness or the firmness of the original.

Figure 3:
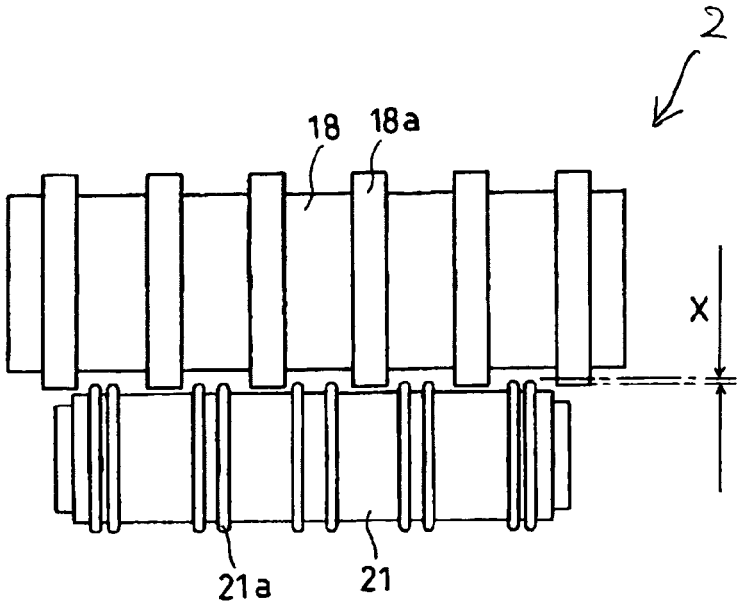
FIG. 3 is a front view for explaining an engagement amount of a feed roller and a separation roller for ordinary-thickness paper.

As shown in FIG. 3, the feed roller 18 and the separation roller 21 are parallel to each other. Convex portions 18*a* and 21*a* protruding in a diameter direction of the roller shafts 40 and 42 are formed on outer circumferences of the feed roller 18 and the separation roller 21 at predetermined intervals. A plurality of convex portions 18*a* is formed on the surface of the feed roller 18, and a plurality of convex portions 21*a* is formed on the surface of the separation roller 21. Namely, each of the feed roller 18 and the separation roller 21 is a comb tooth-like roller with convex and concave portions formed thereon. The convex portions 18*a* of the feed roller 18 can be made of rubber. The convex portions 21*a* of the separation roller 21 can be formed by fitting O-rings into the outer circumference of the separation roller 21. The distance between any two convex portions 18*a* can be same or can vary. The distance between any two convex portions 21*a* can be same or can vary.

As shown in FIG. 3, the convex portions 18*a* of the feed roller 18 enter between the convex portions 21*a* of the separation roller 21. That is, the feed roller 18 and the separation roller 21 "engage" with each other without making a physical contact. The distance between outer ends of the convex portions 18*a* and 21*a* is called the engagement amount, which is X in FIG. 3. Specifically, each of the convex portions 18*a* of the feed roller 18 slightly engages with a concave portion of the separation roller 21. Moreover, each of the convex portions 21*a* of the separation roller 21 slightly engages with a concave portion of the feed roller 18. The noncontact portion serves as a nipping portion, which applies a deformation of a lateral wave to the original that passes through the nipping portion.

The engagement amount can be changed by operating the changing member 44 so that the engagement amount is appropriate for the thickness of the original. In addition, an air layer (a gap between the two originals) is generated by a flexure of each original, and the originals can be separated from one another due to the air layer. It is possible to enlarge a range of available originals.

Figure 4:
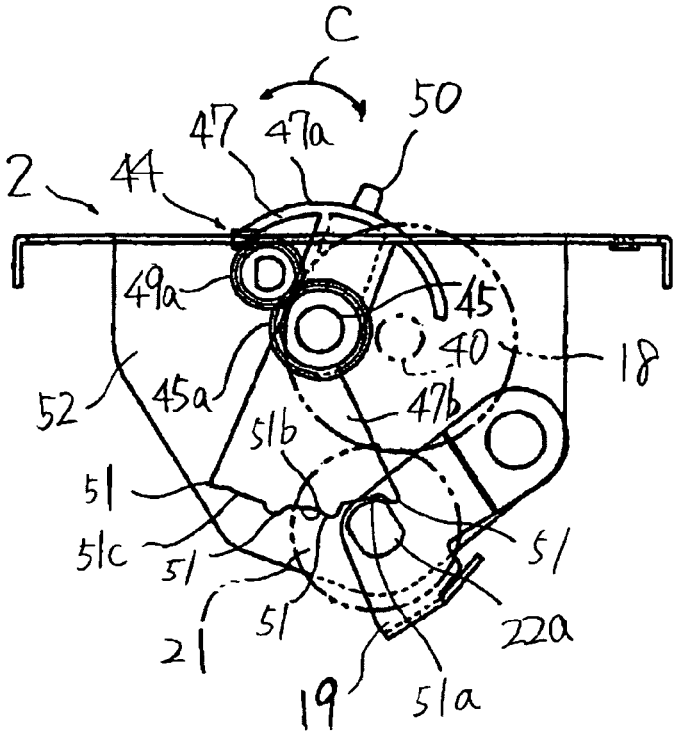
FIG. 4 is a schematic of a first lever of a changing member included in the automatic original feeder shown in FIG. 1.
Figure 5:
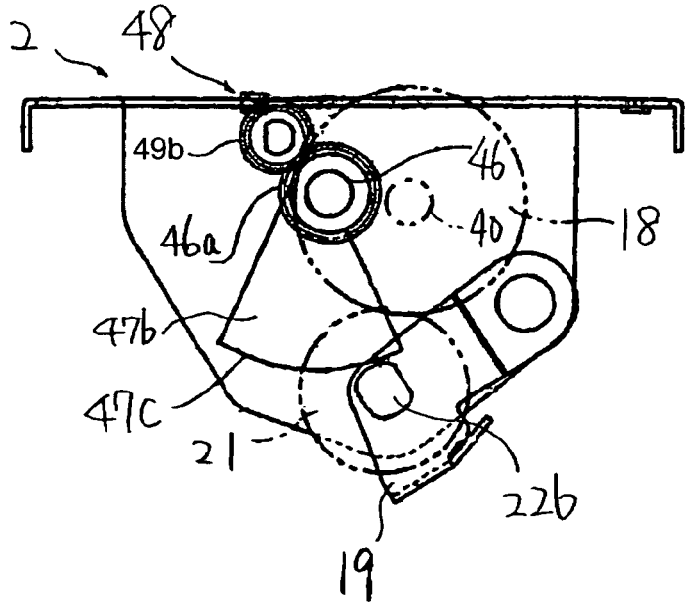
FIG. 5 is a schematic of a second lever of the changing member included in the automatic original feeder shown in FIG. 1.
Figure 6:
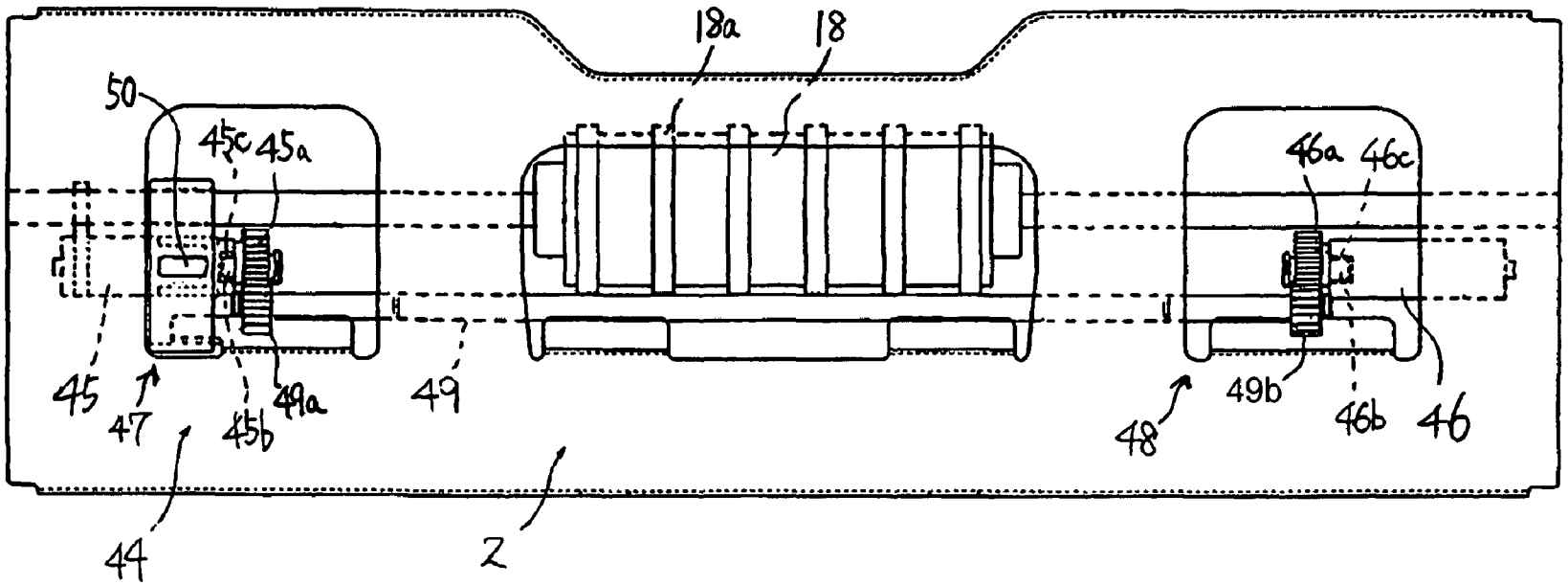
FIG. 6 is a plan view of the separating and feeding unit in the automatic original feeder shown in FIG. 1.

As shown in FIGS. 4 and 5, the changing member 44 includes a first lever (an operating unit) 47 and a second lever (an interlocked unit) 48. The first lever 47 is rotatable around a first rotational shaft (a rotational shaft) 45 in a direction of an arrow C shown in FIG. 4. The first rotational shaft 45 is provided at a position adjacent to one end of the feed roller shaft 40 in parallel to the feed roller shaft 40. The second lever 48 is rotatable around a second rotational shaft 46 in the same direction as the rotation direction of the first lever 47. The second rotational shaft 46 is provided on the other end of the feed roller shaft 40 in parallel to the feed roller shaft 40.

A gear 45*a* is fixed to the first rotational shaft 45, and a gear 46*a* is fixed to the second rotational shaft 46. A transmission gear 49*a* is fixed to one end and a transmission gear 49*b* is fixed to another end of a transmission shaft 49, and the transmission gear 49*a* engages with the gear 45*a* and the transmission gear 49*b* engages with the gear 46*a*. In other words, the first lever 47 is coupled with the second lever 48 via the gears 45*a*, 49*a*, the transmission shaft 49, and the gears 46*a*, 49*b*, and the first lever 47 and the second lever 48 operate in an interlocked manner. This mechanism makes it possible to couple the first lever 47 and the second lever 48 with a simple and compact structure. The gear 45*a* has a convex portion 45*b* and the gear 46*a* has a convex portion 46*b*, the first rotational shaft 45 has a concave portion 45*c* and the second rotational shaft 46 has a concave portion 46*c*, and the convex portion 45*b* engages with the concave portion 45*c* and the convex portion 46*b* engages with the concave portion 46*c*. Because the convex portions 45*b* and 46*b* attached to the gears 45*a* and 46*a* are simply fitted into the concave portions 45*c* and 46*c*, both assembly and configuration of the gears 45*a* and 46*a* can be made simple.

Configurations of the first lever 47 and the second lever 48 will be explained below. The second lever 48 is almost identical in configuration to the first lever 47 except that the second lever 48 does not include a knob 50 and protrusions 51 are not provided on the other end of the second lever 48. Only the configuration of the first lever 47 will be explained.

Figure 7:
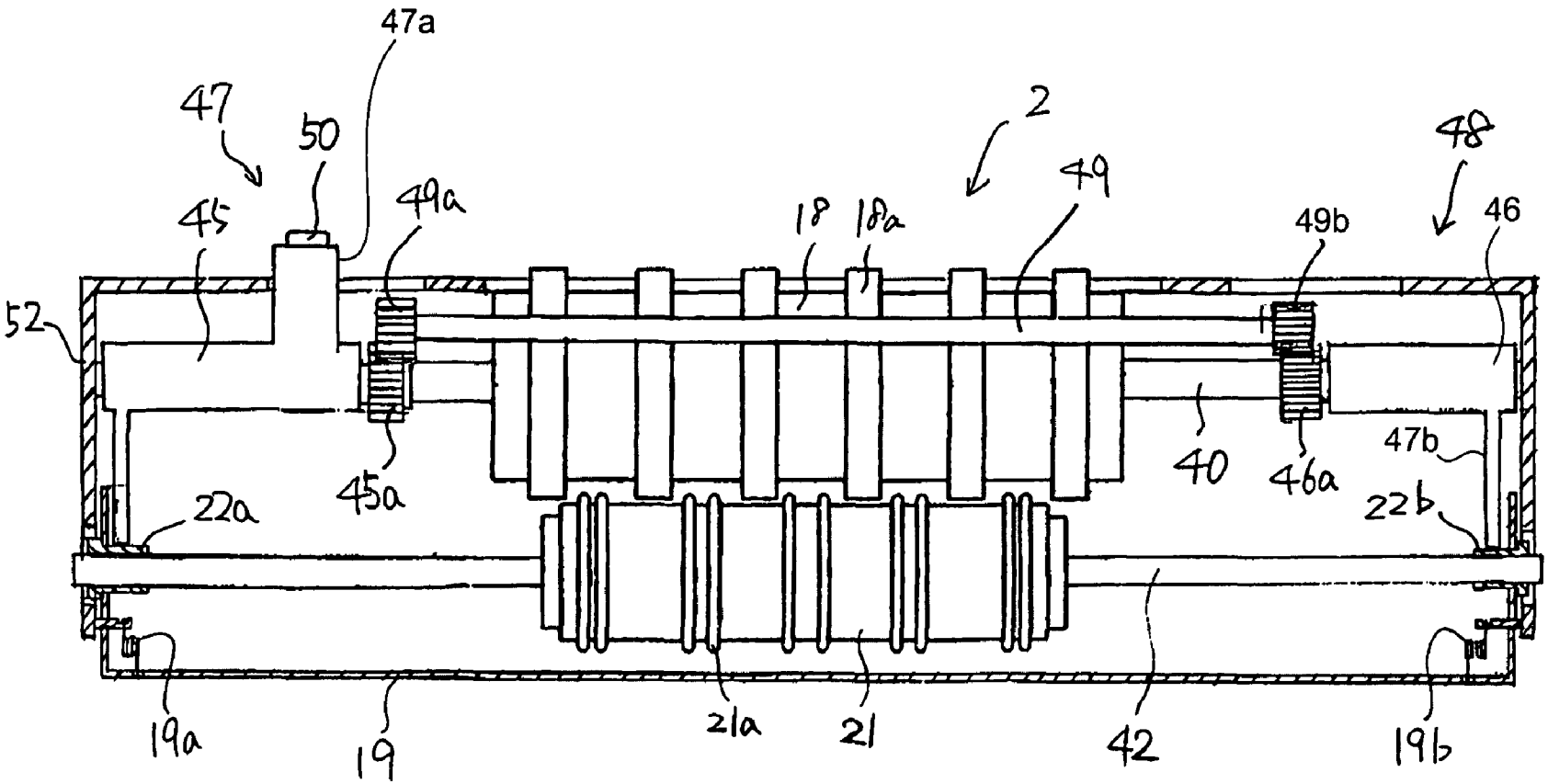
FIG. 7 is a longitudinal sectional view of the separating and feeding unit included in the automatic original feeder shown in FIG. 1.

As shown in FIGS. 4 and 7, one end 47*a* of the first lever 47 protrudes outside of the automatic original feeder 60. The knob 50 is attached to the protruding end 47*a*. A user holds the knob 50 with fingers and rotates the first lever 47 in the direction of the arrow C. As a result, the other end (an abutment portion) 47*b* of the first lever 47 rotates in the direction of the arrow C.

The knob 50 is provided at a position away from a side plate 52, to which the first rotational shaft 45 is rotatably coupled, and close to a central portion of the first rotational shaft 45 in a direction of the first rotational shaft 45. Because of such a location of the knob 50, there is no need to provide an opening for protruding the knob 50 at a position near the side plate 52, and it is possible to prevent deterioration of the strength of the side plate 52. Furthermore, the knob 50 is provided at the position slightly away from the central portion and slightly closer to an end of the first rotational shaft 45 in the shaft direction. Due to this, the distance between the user and the knob 50 can be made smaller, so that the user can operate the knob 50 more easily. It is to be noted that the knob 50 and the other end 47*b* of the first lever 47 are formed integrally with each other and made of resin. Because the knob 50 and the other end 47*b* are formed integrally, the number of components can be reduced.

The other end 47*b* of the first lever 47 is located within the automatic original feeder 60 and formed generally into a fan shape. Four protrusions 51 are formed on the circumference of the fan at predetermined intervals.

Concave portions 51*a*, 51*b*, and 51*c* each having a concave circular-arc shape are formed between adjacent protrusions 51 on the fan. The distance from rotation center of the other end 47*b* to the edge, i.e., radius of curvature, is different for each of the concave portions 51*a*, 51*b*, and 51*c*. Therefore, depending on whether the separation roller shaft 42 is engaged with the concave portion 51*a*, 51*b*, or 51*c*, the amount of displacement of the separation roller shaft 42 changes, in other words, the engagement amount X between the feed roller 18 and the separation roller 21 changes.

The radius of curvature, for example, increases from the concave portion 51*a*, 51*b*, 51*c*. When the separation roller shaft 42 engages with the concave portions 51*c*, which has the longest radius of curvature, the distance between the separation roller shaft 42 and the feed roller shaft 40 is the longest, in other words, the engagement amount is smallest. When the separation roller shaft 42 engages with the concave portions 51*a*, which has the shortest radius of curvature, the distance between the separation roller shaft 42 and the feed roller shaft 40 is the shortest, in other words, the engagement amount is highest. In the first embodiment, the concave portions 51*a*, 51*b*, and 51*c* have different radii of curvature. The radii of curvature are set to satisfy a relationship of (the radius of curvature of the concave portion 51*a*)<(the radius of curvature of the concave portion 51*b*)<(the radius of curvature of the concave portion 51*c*). Needless to say, the radii of curvature of the respective concave portions 51*a*, 51*b*, and 51*c* can be appropriately changed without being restricted to the relationship of magnitude.

Figure 9:
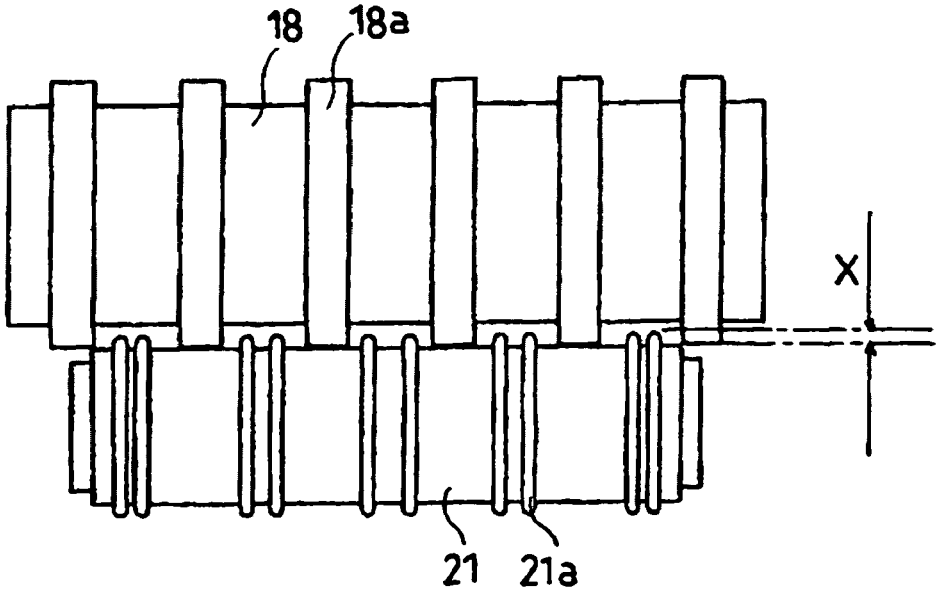
FIG. 9 is a front view for explaining an engagement amount of the feed roller and the separation roller for thinner paper.

When the original is thinner paper (i.e., thinner than 45K) the user operates the knob 50 so that the separation roller shaft 42 engages with the concave portions 51*a*, i.e., sets the knob 50 in a thinner paper mode. As shown in FIG. 9, in the thinner paper mode, the engagement amount X is larger, i.e., 1.3 millimeters. Thin papers have low coefficient of friction. By setting larger engagement amount X for thinner papers, it is possible to facilitate and ensure separation of the originals.

The protrusions 51 are provided only to the first lever 47 (see FIG. 4) and not provided to the second lever 48 (see FIG. 5). As a result, there is an advantage that an engagement backlash often occurs between the gears 45*a* and 49*a* and between the gears 45*a* and 49*b* although the gears 45*a*, 46*a*, 49*a*, and 49*b* enable the first lever 47 and the second lever 48 to operate in the interlocked manner. Furthermore, the transmission shaft 49 is often deflected to make it difficult to accurately transmit a rotational operation performed by the first lever 47 to the second lever 48. Even so, it is possible to ensure that change of the engagement amount X is prevented only by the protrusions 51 of the first lever 47.

Figure 8:
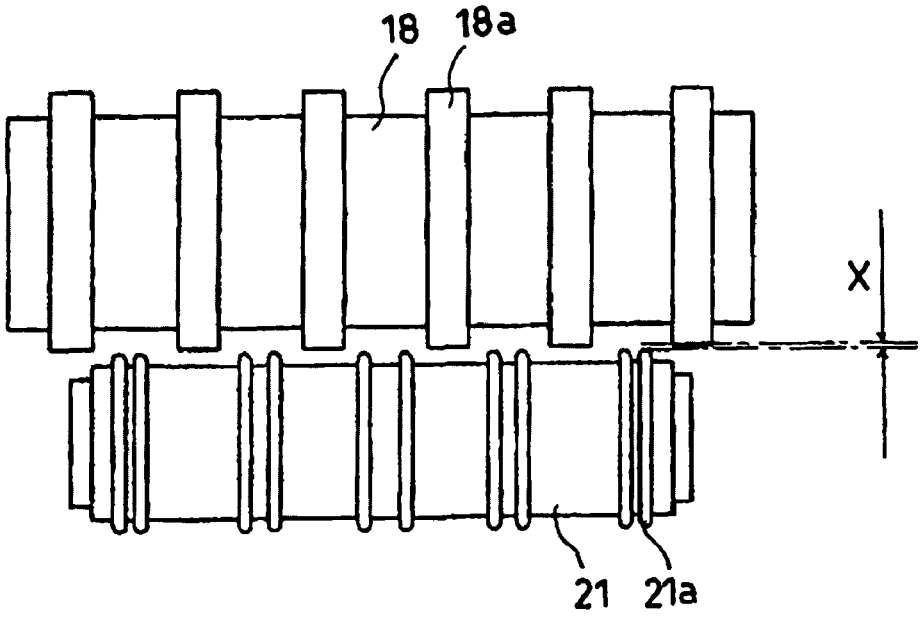
FIG. 8 is a front view for explaining an engagement amount of the feed roller and the separation roller for thicker paper.

When the original is thicker paper (i.e., between 110K and 135K thick) the user operates the knob 50 so that the separation roller shaft 42 engages with the concave portions 51*c*, i.e., sets the knob 50 in a thicker paper mode. As shown in FIG. 8, in the thicker paper mode, the engagement amount X is smaller, i.e., 0.4 millimeter. Thick papers have higher coefficient of friction. By setting smaller engagement amount X for thicker papers, it is possible to facilitate and ensure separation of the originals.

When the original is ordinary-thickness paper (i.e., between 45K and 110K thick) the user operates the knob 50 so that the separation roller shaft 42 engages with the concave portions 51*b*, i.e., sets the knob 50 in an ordinary paper mode. As shown in FIG. 3, in the ordinary paper mode, the engagement amount X is in between, i.e., 0.9 millimeter. Ordinary papers have intermediate coefficient of friction. By setting intermediate amount X for ordinary-thickness papers, it is possible to facilitate and ensure separation of the originals.

An experiment was conducted while the engagement amount X was set to 0.4 millimeter for the thicker paper, 0.9 millimeter for the ordinary-thickness paper, and 1.3 millimeters for the thinner paper. As a result, it was possible to effectively prevent turnover of the original and occurrence of inability to feed the original.

In this manner, according to the first embodiment, the engagement amount X is changed to satisfy the relationship of (the engagement amount X for thinner paper)>(the engagement amount X for ordinary-thickness paper)>(the engagement amount X for thicker paper). A user can easily change the engagement amount X depending on the thickness of paper by operating the knob 50. In addition, because of the switching over among the concave portions 51*a*, 51*b*, and 51*c* only based on the thickness of the original, the user can easily determine which mode is to be used.

Moreover, irregularities are formed on the other end 47*b* of the first lever 47 by the protrusions 51 and the concave portions 51*a*, 51*b*, and 51*c* formed among the protrusions 51. As shown in FIG. 4, if the separation roller shaft 42 is fitted into, for example, the concave portion 51*a* formed between the protrusions 51, the protrusion 51 on the both sides of the concave portion 51*a* can prevent detachment of the separation roller shaft 42 in the rotation direction of the first lever 47. The same thing is true for the concave portions 51*b* and 51*c*.

Furthermore, only by changing the radii of curvature of the concave portions 51*a*, 51*b*, and 51*c*, the engagement amount X between the feed roller 18 and the separation roller 21 can be freely changed. The automatic original feeder 60 according to the first embodiment can, therefore, deal with the originals of various thicknesses.

Each of the bearings 22*a* and 22*b* on which the other end 47*b* of the first lever 47 abut has a polygonal cross section. Due to this, a contact area by which the other end 47*b* contacts with the bearing 22*a* or 22*b* is large and a frictional force between the other end 47*b* and each of the bearings 22*a* and 22*b* is high. It is, therefore, possible to prevent poor engagement between the protrusions 51 and the concave portions 51*a*, 51*b*, and 51*c*. Each of the bearings 22*a* and 22*b* is a sintered bearing. It is, therefore, possible to suppress wearing of a surface of the other end 47*b* that abuts on the bearings 22*a* and 22*b*.

The separation roller 21 is held to be separable and connectable to the feed roller 18. Therefore, the feed roller 18 is not moved upward of the pickup roller 16, and it is possible to prevent slipping of the original and occurrence of feed defect.

Meanwhile, as shown in FIG. 2, the separating and feeding unit 2 includes the extending unit 53 and the dip switch 55. The extending unit 53 sets the time of driving the pickup roller 16 to time that exceeds the reference time. The dip switch 55 actuates the extending unit 53. The user operates the dip switch 55 to actuate the extending unit 53 so as to set the time of driving the pickup roller 16 longer than normal driving time.

In normal operation, the time of driving the pickup roller 16 is time since the driving of the pickup roller 16 is started until the original detection sensor (not shown) provided right after the feed roller 18 detects the trailing edge of the original introduced by the pickup roller 16. If the user depresses the dip switch 55 to switch the automatic original feeder 60 into an extension mode, the time of driving the pickup roller 16 is extended to time since the driving of the pickup roller 16 is started until an original detection sensor (not shown) provided right after the first transport roller 25 detects the trailing edge of the original. Namely, the time of driving the pickup roller 16 is extended by as much as the time required for the original to arrive at the first transport roller 25 from between the feed roller 18 and the separation roller 21.

The extension mode is used when the original is, for example, special paper (onion skin paper or non-carbon paper; a thickness of 30K and a low coefficient of friction). The special paper differs in the coefficient of friction and in surface roughness according to types. It is, therefore, difficult to set the first lever 47 to an appropriate mode when the original is very thin, i.e., "special". For special paper, the user operates the knob 50 to the thinner paper mode, and operates the dip switch 55 to switch the mode of the first lever 47 over to an extension mode. In the extension mode, the transport time of the original is extended. By extending the transport time, an insufficient force of feeding the original after the separation due to the surface roughness of the special paper can be compensated. Furthermore, only by operating the dip switch 55, the automatic original feeder 60 can deal with the special paper. Therefore, it is possible to easily deal with special paper of various types which can be conventionally dealt with only individually.

Figure 11:
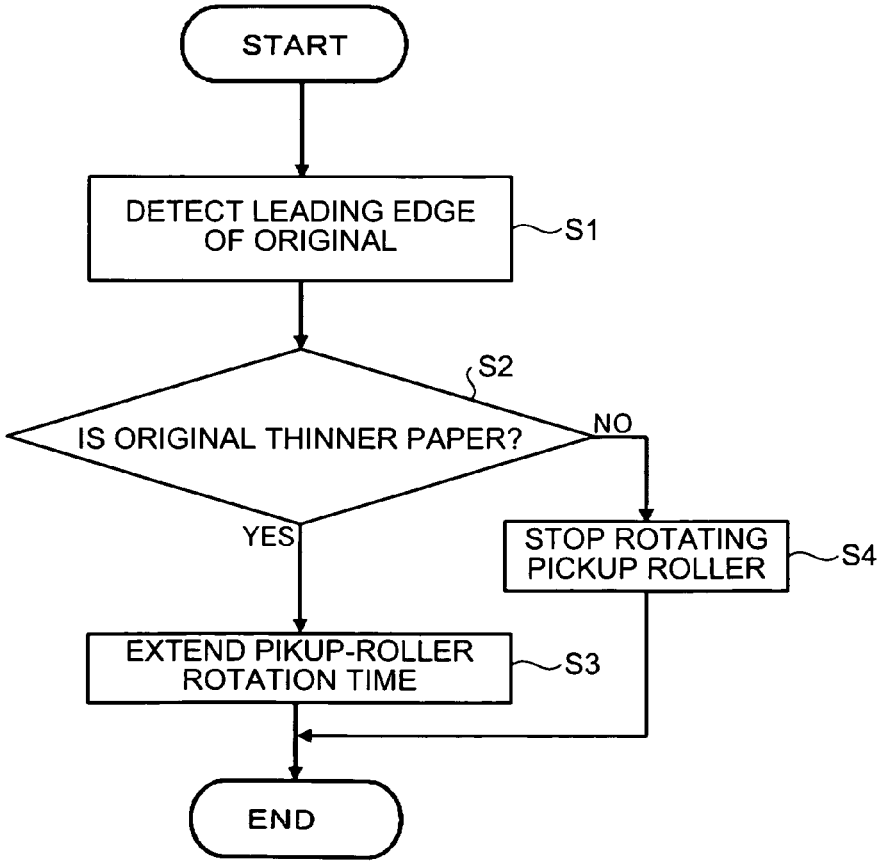
FIG. 11 is a flowchart of a feeding operation performed by the automatic original feeder shown in FIG. 10.

An automatic original feeder according to a second embodiment of the present invention will be explained. In the second embodiment, constituent elements that exhibit the same functions and advantages as those of the constituent elements according to the first embodiment are denoted by the same reference symbols as those used in the first embodiment, respectively. The same constituent elements will not be explained and only different constituent elements will be explained in the second embodiment. FIG. 11 is a flowchart of a feed operation performed by the automatic original feeder according to the second embodiment.

Figure 10:
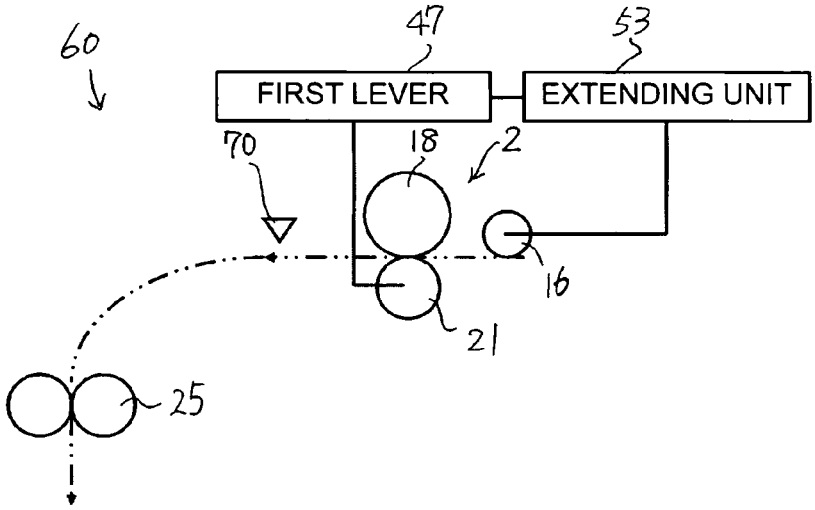
FIG. 10 is a schematic of an automatic original feeder according to a second embodiment of the present invention.

In the second embodiment, the first lever 47 is electrically connected to the extending unit 53. Due to this, if the mode of the first lever 47 is switched over to the thinner paper mode, the driving of the pickup roller 16 is extended. Namely, an original detection sensor 70 (see FIG. 10) provided right after the feed roller 18 detects the leading edge of the original (step S1). The extending unit 53 then determines whether the first lever 47 is in the thinner paper mode, i.e., whether the original is thinner paper (step S2). If the extending unit 53 determines that the original is thinner paper (step S2, Yes), the extending unit 53 extends the time of driving the pickup roller 16 by as much as the time required until the original arrives at the first transport roller 25 from between the feed roller 18 and the separation roller 21 (step S3). If the extending unit 53 determines that the original is not thinner paper (step S2, No), the driving of the pickup roller 16 is not extended and the rotation of the pickup roller 16 is stopped (step S4).

In the second embodiment, when the user sets the mode to the thinner paper mode, the driving of the pickup roller 16 is extended. Therefore, there is no need to operate the dip switch 55.

The present invention is not limited to the first and the second embodiments but various changes and modifications can be made of the invention without departure from the concept of the invention.

In the above embodiments, the automatic original feeder 60 is applied to the image forming apparatus; however, the automatic original feeder 60 can be applied to other devices that require automatic feeding of papers such as image scanners or facsimile machines.

In the first and second embodiments, two levers, i.e., the first and second levers 47 and 48 are employed; however, only one of the first and second levers 47 and 48 can be employed.

In the first and second embodiments, the concave portion 51*a*, 51*b*, or 51*c* engages with the separation roller shaft 42 to change the engagement amount. Alternatively, the concave portion 51*a*, 51*b*, or 51*c* can be made to engage with the feed roller shaft 40. Moreover, the concave portion 51*a*, 51*b*, or 51 can be made to engage with both the feed roller shaft 40 and the separation roller shaft 42.

Furthermore, in the first and second embodiments, three concave portions 51*a*, 51*b*, and 51*c* are provided the first lever 47; however, the number of concave portions is not limited to three, i.e., two or more than three concave portions can be provided.

Figure 12A:
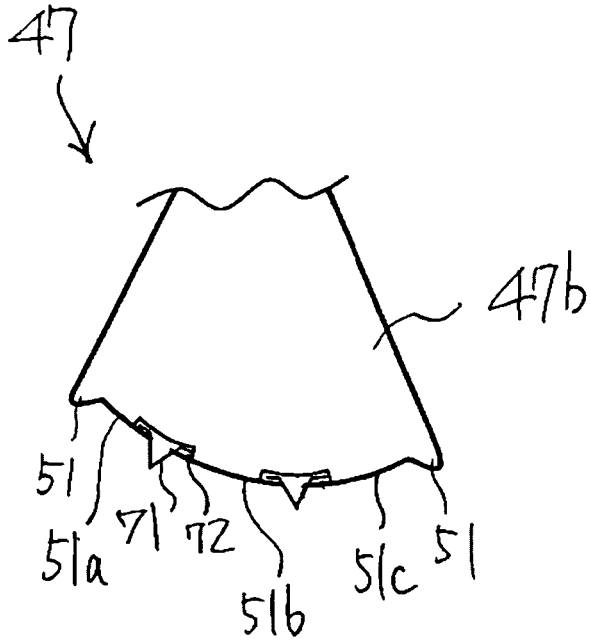
FIGS. 12A and 12B are schematics of a first lever changing member according to a modification of the embodiments.
Figure 12B:
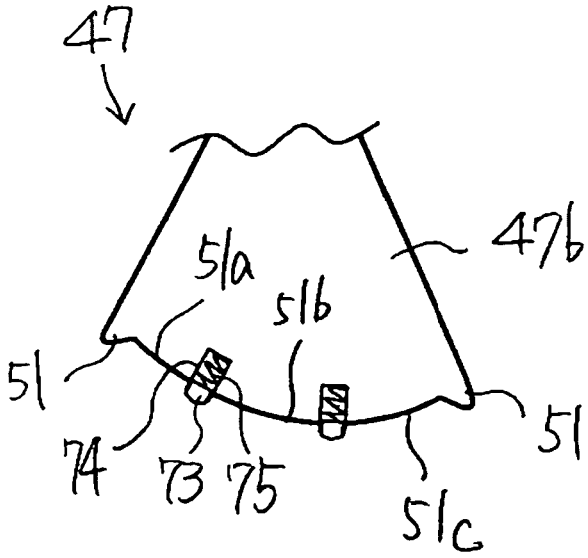

In the first and second embodiments, the protrusions 51 of the first lever 47 are formed integrally with the other end 47*b*. However, the present invention is not limited to the embodiments. As shown in FIG. 12A, a concave portion 72 can be formed in the other end 47*b* and a plate spring 71 can be provided in the concave portion 72. In this configuration, when the other end 47*b* of the first lever 47 rotates due to operation of the knob 50, the plate spring 71 deforms, the bearing 22*a* that abuts on the other end 47*b* strides over the concave portions 51*a*, 51*b*, and 51*c* so that a click sound is produced. As a result, whenever a user operates the knob 50, he/she can feel a firm sense of operation which makes it possible for the user to ensure the switching operation. Furthermore, as shown in FIG. 12B, a spring 75 may be provided in a concave portion 74 of the other end 47*b* so that a protrusion 73 attached to a tip end of the spring 75 can freely protrude or retreat with respect to the other end 47*b*. In this configuration, similarly to FIG. 12A, whenever the mode of the first lever 47 is switched, the spring 75 is elastically deformed. Therefore, an operator can feel a firm sense of operation to make it possible to ensure the switching operation.

According to the present invention, the automatic original feeder includes the changing member that changes the engagement amount between the feed roller and the separation roller. Therefore, the changing member can change the engagement amount according to the thickness of the original, and the range of available originals can be enlarged.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. An automatic original feeder comprising:

a rotatable feed roller having a plurality of feed convex portions on a surface of the feed roller;

a rotatable separation roller that rotates in an opposite direction to a direction of rotation of the feed roller, the separation roller having a plurality of separation convex portions on a surface of the separation roller, the feed roller and the separation roller being arranged so that the feed convex portions and the separation convex portions engage with each other alternately and feed an original from the engaged portion to a unit on downstream side in a direction of feeding of the original; and a changing member that changes an amount of engagement between the feed roller and the separation roller, wherein the changing member includes an operating unit, wherein a person can operate the operating unit to change the amount, wherein the operating unit includes:

a knob unit;

a generally fan-shaped abutment unit coupled to the knob unit, wherein the abutment unit has at least two portions having different radii of curvature near the wide edge of the fan; and a rotational shaft that rotatably holds the abutment unit, the wide edge of the fan of the abutment unit abuts on a separation roller shaft of the separation roller, and when the knob unit is operated, the abutment unit rotates with the rotational shaft as center, and the portions having different radii of curvature of the abutment unit push the separation roller shaft away from the feed roller depending on the radii of curvature, wherein the operating unit is provided on one end of the separation roller, an interlocked unit is provided on other end of the separation roller, and the operating unit and the interlocked unit operate in an interlocked manner through a transmission shaft, and further comprising a gear that is integrally fitted to the rotational shaft of the operating unit so that rotation of the operating unit is transmitted to the transmission shaft through the gear.

2. The automatic original feeder according to claim 1, further comprising a protrusion provided between the two portions composed of a first portion and a second portion, the first portion and the second portion each having a different radius of curvature, so as to control a rotation of the abutment unit.

3. The automatic original feeder according to claim 1, wherein the changing member changes the amount according to a thickness of the original.

4. The automatic original feeder according to claim 1, wherein the changing member sets the amount to 0.9millimeter when the original has ordinary-thickness, the amount to 0.4millimeter when the original is thicker than the ordinary-thickness, and the amount to 1.3millimeters when the original is thinner than the ordinary-thickness.

5. The automatic original feeder according to claim 1, further comprising:

a pickup roller that pick-up an original set on an original setting unit and introduces picked-up original between the feed roller and the separation roller;

a time adjusting unit that adjusts time of driving the pickup roller based on thickness of the original; and a switch for activating the time adjusting unit.

6. The automatic original feeder according to claim 1, wherein the knob unit and the abutment unit are formed integrally with each other.

7. The automatic original feeder according to claim 1, wherein the knob unit of the operating unit is provided on one end of the separation roller.

8. The automatic original feeder according to claim 1, further comprising:

a side plate arranged on an end of the separation roller shaft; and a bearing that rotatably supports the separation roller shaft, wherein the abutment unit abuts on the bearing, and the knob unit of the operating unit is provided at a position away from the side plate and close to the center of the separation roller shaft.

9. The automatic original feeder according to claim 8, wherein the bearing has a polygonal cross section.

10. The automatic original feeder according to claim 8, wherein the bearing is a sintered bearing.

11. The automatic original feeder according to claim 8, wherein the abutment unit of the operating unit is formed with a plurality of protrusions on a circumference thereof, and the bearing is stopped between adjacent protrusions.

12. The automatic original feeder according to claim 11, wherein the plurality of protrusions is formed on the abutment unit of the operating unit.

13. The automatic original feeder according to claim 1, wherein the knob unit and the abutment unit are made of resin.

* * * * *